United States Patent [19]

Chase

[11] 4,208,954

[45] Jun. 24, 1980

[54] METHOD FOR USING CONTAINER AND LID

[75] Inventor: William L. Chase, Des Moines, Iowa

[73] Assignee: International Drum Corporation, Des Moines, Iowa

[21] Appl. No.: 915,016

[22] Filed: Jun. 13, 1978

[51] Int. Cl.[2] ..... B65D 5/12

[52] U.S. Cl. ..... 93/36 M; 53/492; 229/23 BT; 229/43

[58] Field of Search ..... 229/43, 45, 23 BT; 206/620, 621, 617; 93/36 M

[56] References Cited

U.S. PATENT DOCUMENTS

| | | | |
|---|---|---|---|
| 2,819,008 | 1/1958 | White et al. | 229/23 BT |
| 2,858,968 | 11/1958 | Pellatom | 229/43 X |
| 2,939,624 | 6/1960 | Wilson | 229/43 |
| 3,966,112 | 6/1976 | Gordon | 229/23 BT |
| 4,053,100 | 10/1977 | Baptist | 229/43 |

*Primary Examiner*—Davis T. Moorhead

*Attorney, Agent, or Firm*—Zarley, McKee, Thomte, Voorhees & Sease

[57] ABSTRACT

The container of the present invention includes polygonal sidewalls with at least some of the upper edges of the side walls each having a container locking flap thereon and with at least one other of the side walls being free from locking flaps. The lid has polygonal edge walls sized to matingly fit over the upper edges of the container side walls. Each of the edge walls of the lid are provided with a lid lock flap which folds upwardly and inwardly with respect to the edge walls and which terminates in an upwardly presented edge spaced downwardly from the top of the lid. When the lid is placed over the top of the container, the lock flaps of the container retentively engage the upwardly presented edges of the lid lock flaps.

The lid may be removed after the first locking by severing the lid lock flaps from the lid with a knife or other cutting instrument. The lid may then be locked a second time over the top of the container by rotating it so that the unsevered locking flaps of the lid are placed in registered alignment with the locking flaps on the upper edges of the container.

1 Claim, 13 Drawing Figures

METHOD FOR USING CONTAINER AND LID

BACKGROUND OF THE INVENTION

1. Field of the Invention

The present invention relates to an improvement in a container lid and a method for using the same. The lid is adapted to have locking flaps which lock the lid in place during shipment. The locking flaps can be removed to permit removal of the lid, but additional locking flaps are provided on the container lid which can be used to lock the lid on the top of the container a second time.

2. Discussion of the Prior Art

Various means have been provided for closing the tops of paperboard and corrugated containers during shipment. Adhesive tape, stapling, various folding configurations, and other closures have been provided. However, many of these closure means are good for only one closure and ruin the carton or the lid to the carton when it is opened after shipment. Lids having flaps which interlock with flaps on the top of the container have been used, but these flaps must be severed at the time of opening after shipment. After these locking flaps are severed, the lid can no longer be used again for shipment.

SUMMARY OF THE INVENTION

The preseent invention uses a polygonal container and locking lid. The lid includes locking flaps thereon in greater numbers than the locking flaps which are provided on the upper edge of the container. Therefore, when the lid is locked for the first time on the upper end of the container, only a portion of the locking flaps on the lid are utilized. After shipment, the locking flaps which are functional are severed and removed so as to permit removal of the lid.

In order to use the lid a second time, it is only necessary to rotate the lid so that the remaining locking flaps thereon are in registered alignment with the locking flaps on the upper end of the container. The lid is then depressed and locked in place for a second shipment.

Lids may be provided which have a number of lid locking flaps which is two, three, four or more times the number of locking flaps provided on the upper edge of the container. This makes possible the use of the lid in two, three, four or more shipments.

Therefore, a primary object of the present invention is the provision of a container having a lid which locks during shipment but can be removed and locked a second time for a second shipment.

A further object of the present invention is the provision of a lid and container which are sturdy in construction.

A further object of the present invention is the provision of a container and lid which utilize a minimum of materials.

A further object of the present invention is the provision of a lid and container which are simple in construction.

A further object of the present invention is the provision of a lid and container which are easily locked together.

A further object of the present invention is the provision of a lid and container which may be locked together and which may be removed easily after shipment of the container.

DESCRIPTION OF THE PREFERRED EMBODIMENT

Figure 7:
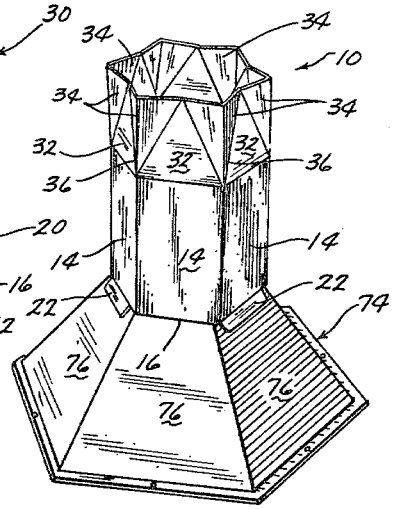
FIGS. 7 and 8 are perspective views showing the sequential positioning of the carton blank on the cone during the folding operation.
Figure 8:
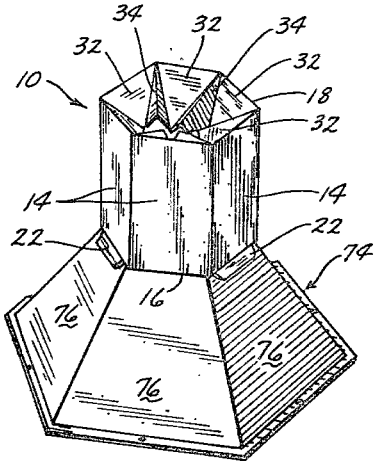

Referring to the drawings, the numeral 10 generally designates a container and the numeral 12 designates a lid for the container. Container 10 is formed from a foldable blank which is shown in FIGS. 6–8 and which may be constructed of corrugated board, paperboard, plastic, or other semi-flexible materials.

Figure 1:
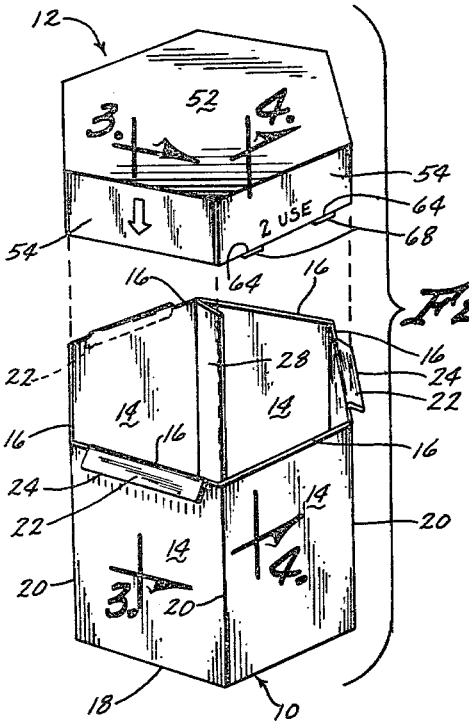
FIG. 1 is a perspective view showing the container and the lid therefor.
Figure 2:
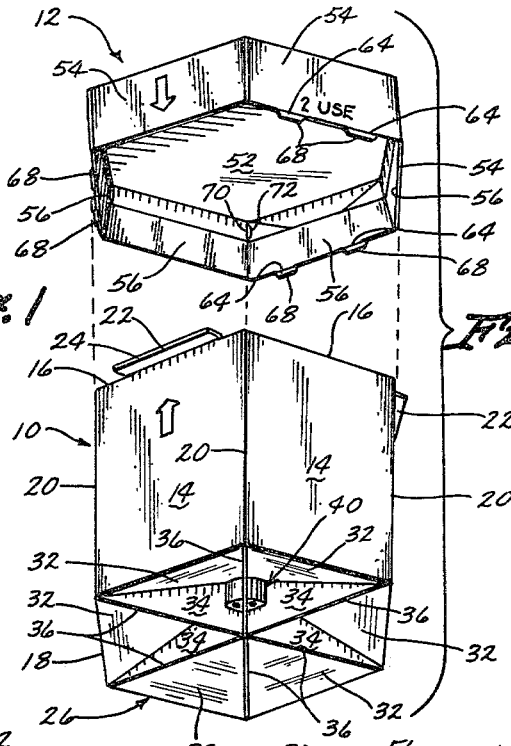
FIG. 2 is a perspective view similar to FIG. 1, but showing the bottom of the container and the under surface of the lid.
Figure 3:
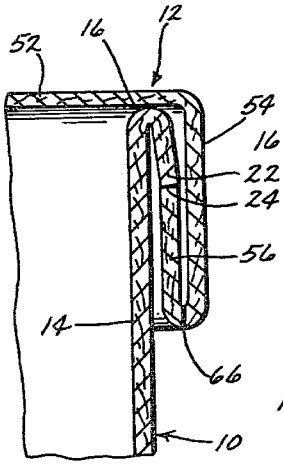
FIGS. 3 and 4 are sectional views taken along lines 3—3 and 4—4 of FIG. 1.

Referring to FIGS. 1–2, the folded and assembled container includes a plurality of rectangular sidewalls 14 each of which includes a top edge 16, a bottom edge 18, and lateral edges 20. Every other top edge 16 is provided with a container locking flap 22 which is foldable outwardly and which includes a downwardly presented flap edge 24 (FIGS. 1–3). Container 10 includes a bottom closure generally designated by the numeral 26. Bottom closure 26 will be described in greater detail hereinafter.

Figure 6:
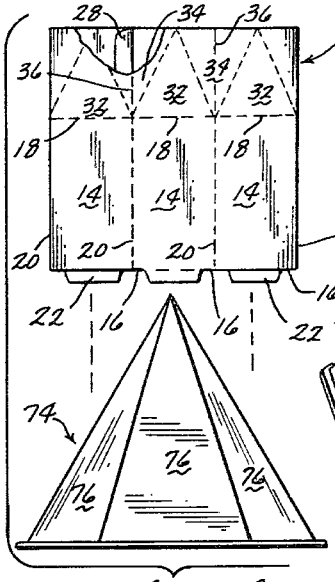
FIG. 6 is a frontal view showing a container blank poised above a cone fixture prior to the folding operation.

A vertical seam 28 joins sidewalls 14 in a tube like configuration, and in FIG. 6 this tube or blank is shown in its original flattened condition. The tube or blank includes pre-scored fold lines which comprise the folds which will be made at edges 16, 18 and 20. Above edges 18 (the blank is shown in an inverted position), is a bottom closure portion generally designated by the numeral 30. Bottom closure portion 30 has a plurality of pre-scored lines which are indicated by the dotted lines thereon. These pre-scored fold lines form a plurality of triangular bottom panels 32, each of which has a triangular base co-existent with bottom edge 18. Between bottom panels 32 are a plurality of inverted triangular webs 34. Each web 34 includes a vertical fold line bisecting the same and designated by the numeral 36.

Figure 13:
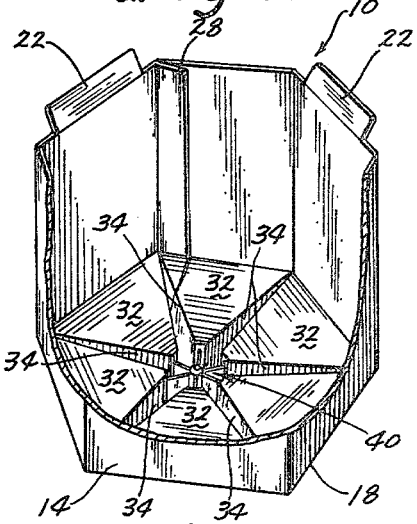
FIG. 13 is a perspective view of the interior surface of the bottom closure having the clip applied thereto.

When completely folded and assembled, container 10 appears as shown in FIGS. 1, 2, 10 and 13. Each web is folded to a double thickness about fold line 36, and extends between a pair of adjacent bottom panels 32. Each bottom panel 32 is hingedly connected to one of the side panels about fold line 18 and is inclined upwardly from the bottom edge 18 of the side panel to which it is connected so as to form an acute angle therewith. Each bottom panel 32 has two side edges which abut adjacent side edges of adjacent bottom panels (FIG. 13). The webs 34 on each side of the bottom panels 32 hingedly connect each bottom panel 32 to an adjacent bottom panel 32, whereby a load which is placed on the bottom interior of container 10 which urges the bottom panels downwardly will be supported by the locking and bearing engagement between the abutting edges of the bottom panels and by the interconnecting webs.

Figure 10:
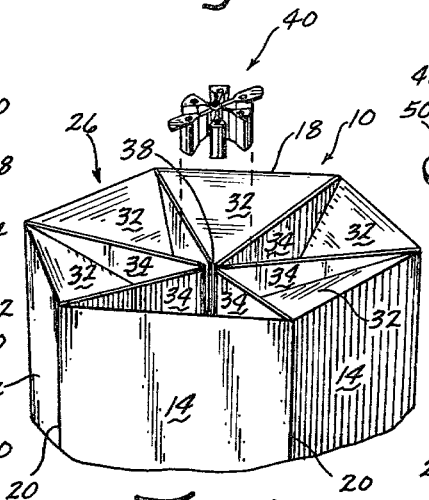
FIG. 10 is a partial perspective view showing the bottom closure of the container and showing the clip poised thereabove for application thereto.

Referring to FIGS. 2 and 10, the undersurface of the bottom closure 26 includes a plurality of ribs which are formed by fold lines 36 of webs 34 and which are arranged in a spoke like fashion. These ribs formed by webs 34 and fold lines 36 include inner radial vertical edges 38 (FIG. 10) which are spaced a short distance from one another at the center of the spoke formed by the radiating ribs.

Figure 11:
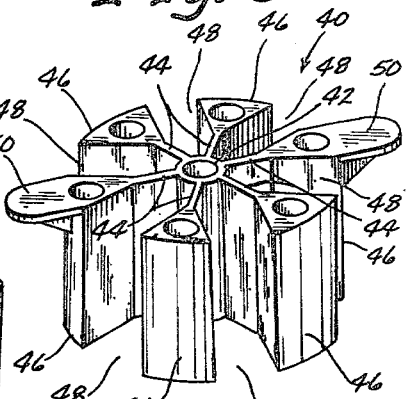
FIG. 11 is a perspective view of the clip used to hold the bottom closure in place.
Figure 12:
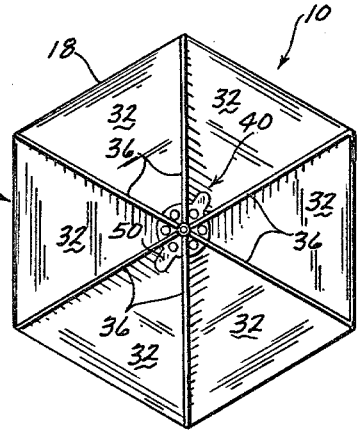
FIG. 12 is a bottom view of the bottom closure having the clip thereon.

A retaining clip 40 retentively engages all of the ribs formed by webs 34 adjacent the inner radial ends 38 thereof. The specific structure of clip 40 is shown in FIG. 11, and includes a hub 42 having a plurality of fingers 44 radiating radially outwardly therefrom. The outer radial end of each finger 44 is provided with an enlarged triangular portion 46 thereon. Fingers 44 and enlarged portions 46 are circumferentially spaced from one another so as to provide a plurality of slots 48 therebetween. Slots 48 extend axially completely through clip 40. A pair of finger tabs 50 extend outwardly from the outer radial edges of clip 40.

Clip 40 is mounted at the inner radial centers of the ribs formed by webs 34 and fold lines 36. The hub 42 of clip 40 is located at the center of the spoke formed by the radiating ribs, and the inner radial ends of each rib are slidably fitted within one of slots 48 within clip 40. Clip 40 is slidably moved upwardly to the extreme upper end of the vertical edges 38 as shown in FIG. 2, so that the bottommost edge of clip 40 is spaced upwardly from bottom edges 18. Edges 38 pass completely through the axial length of slots 48 so that clip 40 can slide freely axially with respect to the axial center of the spoke like array of ribs.

Figure 4:
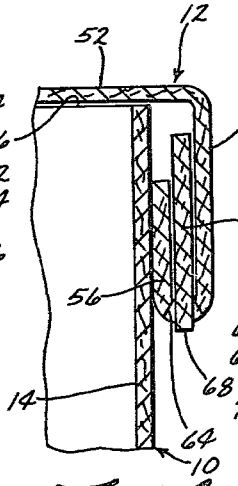

Lid 12 includes a polygonal shaped top wall 52 having a plurality of rectangular side walls 54 which extend downwardly from the lateral edges thereof. Each side wall includes a lid locking flap 56 extending from and folded along the lower edge of each side wall 54. Locking flaps 56 are folded inwardly and into facing engagement with the interior surfaces of sidewalls 54 as is shown in FIGS. 2–4.

Figure 5:
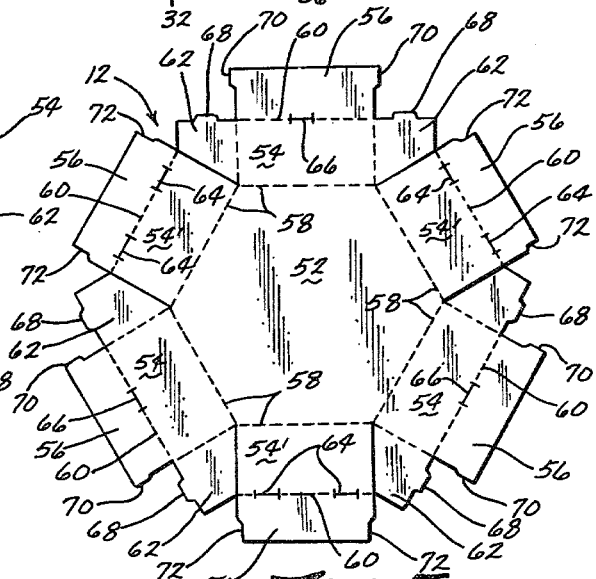
FIG. 5 is a plan view of the container lid in an unfolded configuration.

Referring to FIG. 5, lid 12 is shown in its unfolded blank form. The outer peripheral edges of top wall 52 are shown by fold lines 58. The fold lines between locking flaps 56 and side walls 54 are designated by the numeral 60. Every other side wall 54 is provided with two laterally extending side flaps 62, and the remaining side walls 54 are free from any such side flaps. The side walls without side flaps are designated by the numeral 54'. Fold lines 60 of side flaps 54' are each provided with a pair of H-shaped slits 64 and each side wall 54 is provided with a centrally located slit 66. H-shaped slits 64 are each adapted to receive an upwardly projecting tab 68 on one of side flaps 62 as demonstrated in FIGS. 1–4. The projection of tabs 68 through H-shaped slits 64 forms a lock which retains the lid in its folded configuration. Similarly pairs of lateral tabs 70 on every other locking flap 56 interlock with corresponding notches 72 in the lateral edges of the remaining lock flaps 56, as shown in FIG. 2.

Lid 12 and container 10 are used in the following manner. Prior to shipment the container 10 is filled, and lid 12 is slidably fitted over the upper end of container 10. Depression of lid 12 over the top of container 10 causes the downwardly presented edges of locking flaps 22 to slip by and retentively engage the upwardly presented edges of locking flaps 56, thereby retentively holding lid 12 in position on the top of container 10. (See FIG. 3) The uppermost edge of locking flap 56 is spaced downwardly from top wall 52 of lid 12 a sufficient distance to accommodate container locking flap 22 as shown in FIG. 3.

The number of container locking flaps 22 is less than the number of lid locking flaps 56. The drawings show a relationship whereby there are three locking flaps 22 and six locking flaps 56. However, the ratio may be changed without affecting the invention. For example, there could be two locking flaps 22 and six locking flaps 56 or there could be one locking flap 22 and six locking flaps 26. Furthermore, the number of polygonal sides may be varied, thereby making various permutations and combinations possible with respect to the ratios between flaps 22 and 56. However, in order to provide a reusable lid, it is necessary that there be more locking flaps on the lid 12 than there be on the container top.

After the lid is latched to the top of the container, the container is shipped to its destination. At its destination the container is opened by inserting a knife or other cutting instrument into slot 66 (FIG. 3) and by severing locking flap 56 from lid 12. The only flaps which are severed are those which retentively engage locking flaps 22. For example, in the drawings, there are three locking flaps 22 and six locking flaps 56. With this configuration, only three of the locking flaps 56 are severed, thereby leaving three additional locking flaps 56 for later use.

After severing the locking flaps, the operator can lift the lid 12 from the top of the container, remove the contents, and store the container for later use.

The container can then be used a second time by placing the lid over the container, but in a position which is rotated 30° from the position originally used. This will register the unsevered lock flaps 56 with lock flaps 22. The lid may then be depressed over the top of the container, and the lock flaps 56 will again retentively engage lock flaps 22 as shown in FIG. 3.

By changing the ratio of lock flaps 22 to lock flaps 56, it is possible to increase the number of usages which may be made of lid 12. For example, by placing two lock flaps 22 on the container and six lock flaps 56 on the lid, it would be possible to lock the lid for shipment three separate times.

Referring to FIGS. 6–8, an improved method for folding and forming the container 10 is shown. The container blank shown in FIG. 6 is placed over a polygonal cone 74 which includes a plurality of flat polygonal surfaces 76. Prior to being placed over the cone 74, the blank is inverted so that the top edges 16 engage the surfaces 76 of cone 74 as shown in FIGS. 7 and 8. Once the blank is pressed firmly down over cone 74, it is held in a predetermined polygonal configuration by virtue of the engagement of edges 16 with surfaces 76. Tolerances or variances in the dimensions of the blank are easily accounted for by virtue of the cone shaped configuration of cone 74. Thus, the cone 74 may be used for containers of varying dimensions.

When the polygon is formed into its shape as shown in FIG. 7, the assembler merely folds the bottom closure over into its predetermined position as shown in FIG. 8. The folding of the end closure is facilitated by pre-formed scores or fold lines so that the closure readily assumes the proper position.

Referring to FIGS. 9–13, a method for applying clip 40 to the end closure of the container is as follows: The method comprises the utilization of a fin head fixture 78 having a base pedestal 80 and a vertical support tube 82 which is secured at its lower end to pedestal 80 and which extends upwardly therefrom. Support tube 82 has housed therein a longitudinally slidable plunger 84 which is pivotally secured at its lower end to a foot pedal 86 pivoted about a fulcrum 88. Depression of foot pedal 86 causes upward sliding movement of plunger 84 within tube 82. Plumger 84 is shown in its lowermost position in FIG. 9, and sliding movement of plunger 84 to its uppermost position (not shown) causes the upper end of the plunger to protrude outwardly a predetermined distance from the upper end of tube 82.

Fixed to the upper end of tube 82 are a plurality of fin plates 90, the number of which correspond to the number of ribs formed by webs 34. A centering rim 92 surrounds and is fixed to blades 90. The upper edges of blades 90 protrude a predetermined distance above the uppermost end of tube 82.

Figure 9:
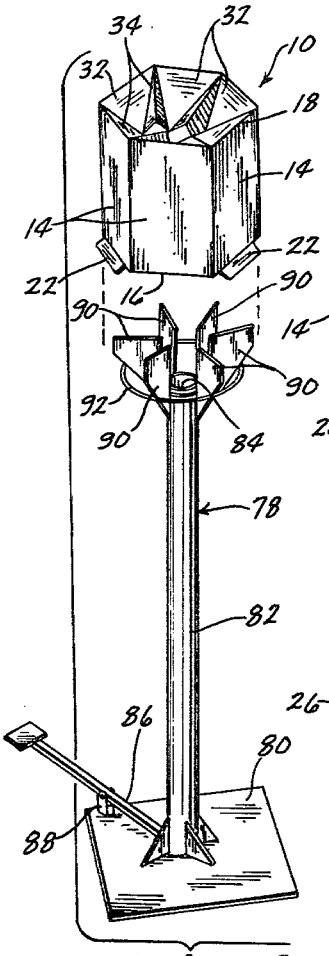
FIG. 9 is a perspective view of the fin head fixture and showing the container poised above the fin head fixture immediately prior to mounting thereon.

In operation, the container blank which has been folded to the position shown in FIG. 8 is removed from cone 74 and is placed above fin head fixture 78 as shown in FIG. 9. Blades 90 are registered below the junctures between the adjacent edges of bottom panels 32. As can be seen in FIG. 13, these junctures form a spoke like configuration which corresponds to the spoke like configuration of plates 90. Container 10 is then lowered over fin plates 90 and fin plates 90 slidably protrude within the junctures between the side edges of bottom panels 32. These junctures are each lined by the two halves of webs 34, and therefore each plate 90 is embraced by the two opposite sides of each web 34. The result of this mating engagement between fin plates 90 and webs 34 is that the ribs formed by webs 34 are prealigned to a proper configuration for receiving clip 40 as shown in FIG. 10. Clip 40 can then be slidably placed over the ribs formed by web 34 so as to lock the ribs together and prevent their movement with respect to one another. The position of clip 40 after it has been inserted is shown best in FIGS. 2 and 13.

From the foregoing description, it will be apparent that container 10 constructed in accordance with the teaching of the present invention, will have a strong weight supporting bottom and can be utilized for numerous shipments. Also, from the foregoing description, it will be apparent that modifications and variations can be made without detracting from the invention, and accordingly the scope of the invention is to be limited as necessitated by the accompanying claims.

I claim:

1. A method for using a polygonal container and lid, said container having polygonal upper edges, and locking flaps extending from at least some of said upper container edges, said locking flaps extending downwardly on the outside of said container and having downwardly presented shoulders, said lid having a top wall and sidewalls, with bottom edges, lid locking flaps extending from said lid sidewall bottom edges, said lid locking flaps being folded upwardly inside said lid sidewalls and having upwardly presented edges spaced downwardly from said top wall, said method comprising:

placing said lid over said open upper end of said container;

depressing said lid to a point wherein a first portion of said lid locking flaps retentively engage said container locking flaps to lock said lid on said container;

removing said lid by severing said first portion of the lid locking flaps from said lid and lifting said lid upwardly from said container;

rotating said lid to a position wherein said second portion of said lid locking flaps still remaining on said lid are in registered alignment above said container locking flaps;

depressing said lid over said container to a point wherein said second portion of lid locking flaps retentively engage said container flaps to secure said lid to said container.

* * * * *